US008087605B2

(12) United States Patent
Lia

(10) Patent No.: US 8,087,605 B2
(45) Date of Patent: Jan. 3, 2012

(54) DAMPING UNIT FOR FILM PACKING DEVICE

(76) Inventor: Tony Lia, Taipei (TW)

( * ) Notice: Subject to any disclaimer, the term of this patent is extended or adjusted under 35 U.S.C. 154(b) by 296 days.

(21) Appl. No.: 12/457,669

(22) Filed: Jun. 18, 2009

(65) Prior Publication Data

US 2010/0320305 A1 Dec. 23, 2010

(51) Int. Cl.
*B65H 23/06* (2006.01)

(52) U.S. Cl. ..... 242/422.4; 242/422.5

(58) Field of Classification Search ..... 242/417.3, 242/422, 422.4–422.5
See application file for complete search history.

(56) References Cited

U.S. PATENT DOCUMENTS

| | | | | |
|---|---|---|---|---|
| 3,602,452 | A * | 8/1971 | Sauer | 242/421.8 |
| 5,054,706 | A * | 10/1991 | Maurice | 242/422.5 |
| 5,964,390 | A * | 10/1999 | Børresen et al. | 226/44 |
| 7,338,004 | B2 * | 3/2008 | Niederer | 242/422.4 |
| 2003/0132336 | A1 * | 7/2003 | Huang | 242/422.4 |

* cited by examiner

*Primary Examiner* — Sang Kim

(57) ABSTRACT

A damping unit for a film packing device a first roller, a damping roller and a second roller connected to the base of the film packing device respectively. The first roller includes a frame connected to the base and a first tube and a second tube are connected to the frame. The damping roller is located between the first and second rollers and has a spring biased on a top thereof so as to control its speed of rotation. The film goes partially around the first tube, the second tube, at least half of an outer periphery of the damping roller and then partially around the second roller before being wrapped around the object.

5 Claims, 6 Drawing Sheets

DAMPING UNIT FOR FILM PACKING DEVICE

BACKGROUND OF THE INVENTION (1) Field of the Invention

The present invention relates to a damping unit for film packing device, and more particularly, to a tension adjustable damping unit for film packing device.

(2) Description of the Prior Art

A conventional film packing device is used to wrap multiple layers of film to objects so as to protect the objects from scrape or rains. The conventional film packing device is shown in FIG. 6 and generally includes a base 60 which is connected with a mandrel 61 which is movable up and down relative to the base 60. A roll 70 of film is mounted to the mandrel 61 and the film 71 is pulled from the roll 70 to wrap around the objects. The objects are located on a rotatable support board and rotated to drag the film 71 to wrap around them. However, the shapes of the objects to be wrapped may not the same so that each point on the object is located at different distance from the mandrel 61. The tension of the film 71 is larger when the object is located closer to the mandrel 61 and smaller when the object is located far from the mandrel 61. The film 71 bends due to the gravity or even attached to each other if the object is located at a distance from the mandrel 61. Therefore, it is important to keep the film 71 with proper tension when packing the objects at different distances.

The present invention intends to provide a damping unit for film packing device wherein the speed of the rotation of the roll of the film can be adjusted so that when the film is dragged by the rotation of the objects, the tension of the film can be maintained.

SUMMARY OF THE INVENTION

The present invention relates to a film packing device which comprises a base with two positioning members connected thereto and a roll of film is connected between the two positioning members. A damping unit comprises a first roller, a damping roller and a second roller. The first roller includes a frame which is connected to the base and includes a rotatable first tube and a second tube. The damping roller has an end connected to the base and is located between the first and second rollers.

The film pulled from the roll of film goes partially around the first tube, the second tube, at least half of an outer periphery of the damping roller and then partially around the second roller.

The primary object of the present invention is to provide a damping unit for film packing device and the tension of the film can be adjusted by operation of the damping unit so as to wrap the objects properly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
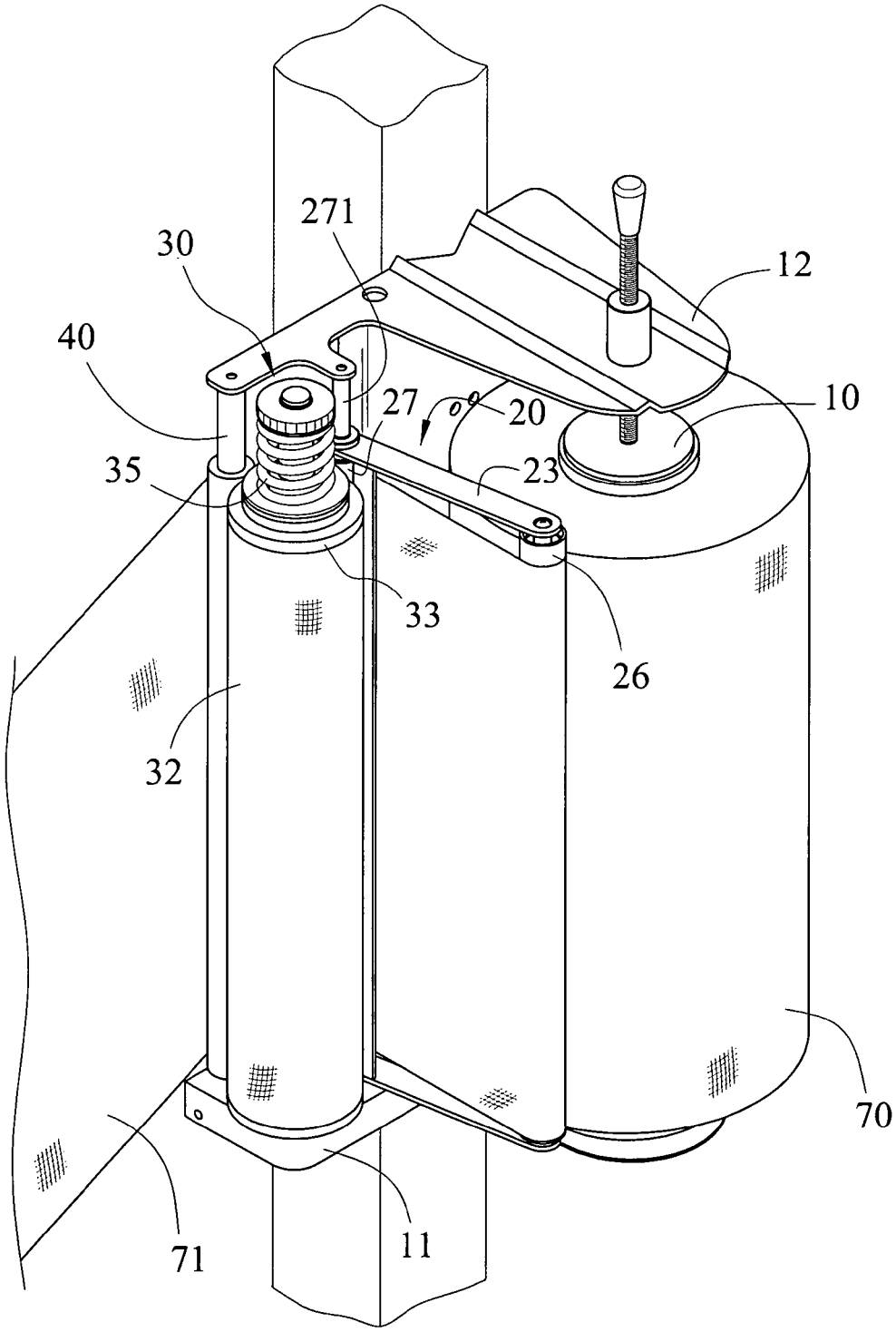
FIG. 1 is a perspective view to show the damping unit connected to the film packing device of the present invention.
Figure 2:
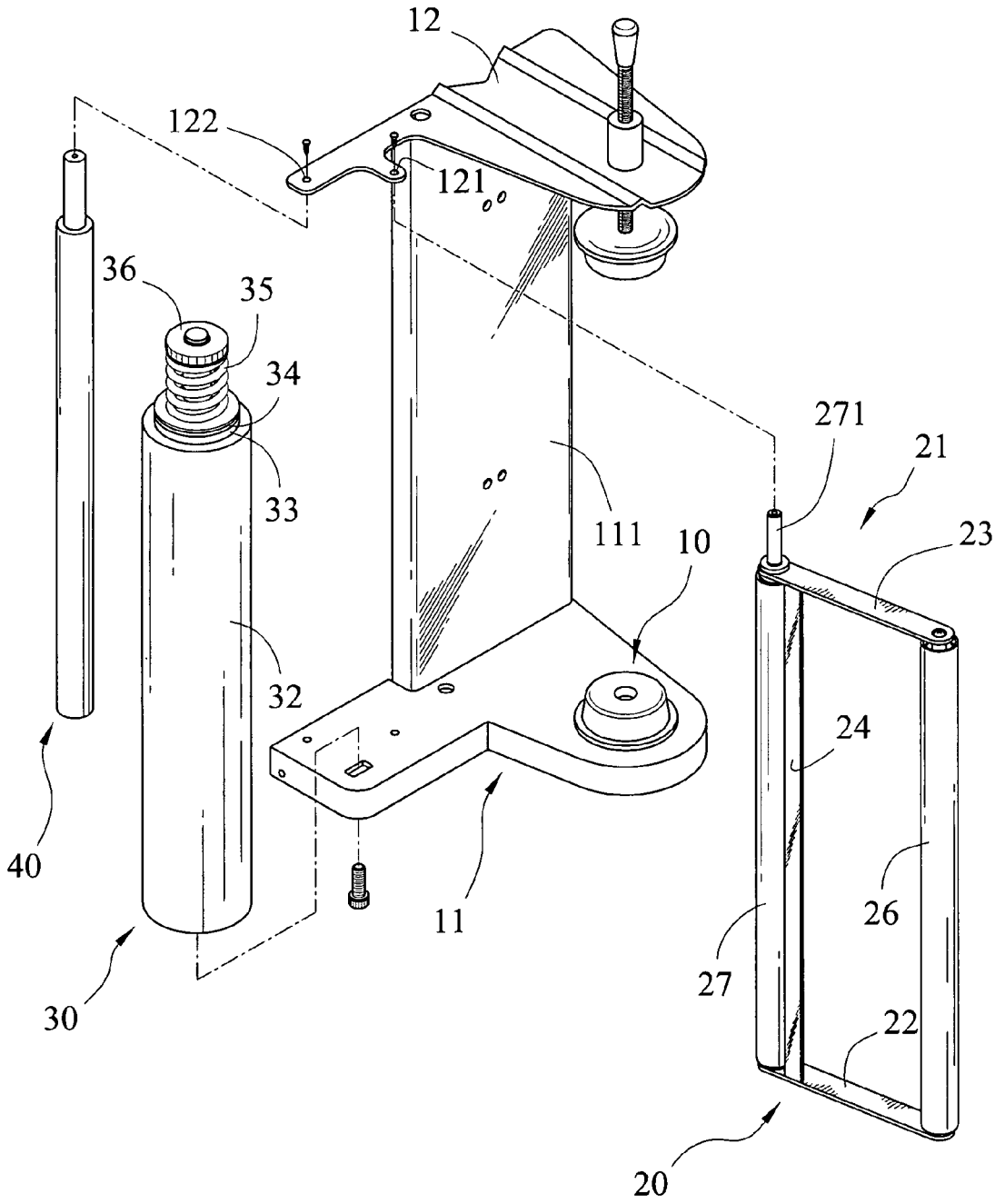
FIG. 2 is an exploded view to show the damping unit of the present invention.
Figure 3:
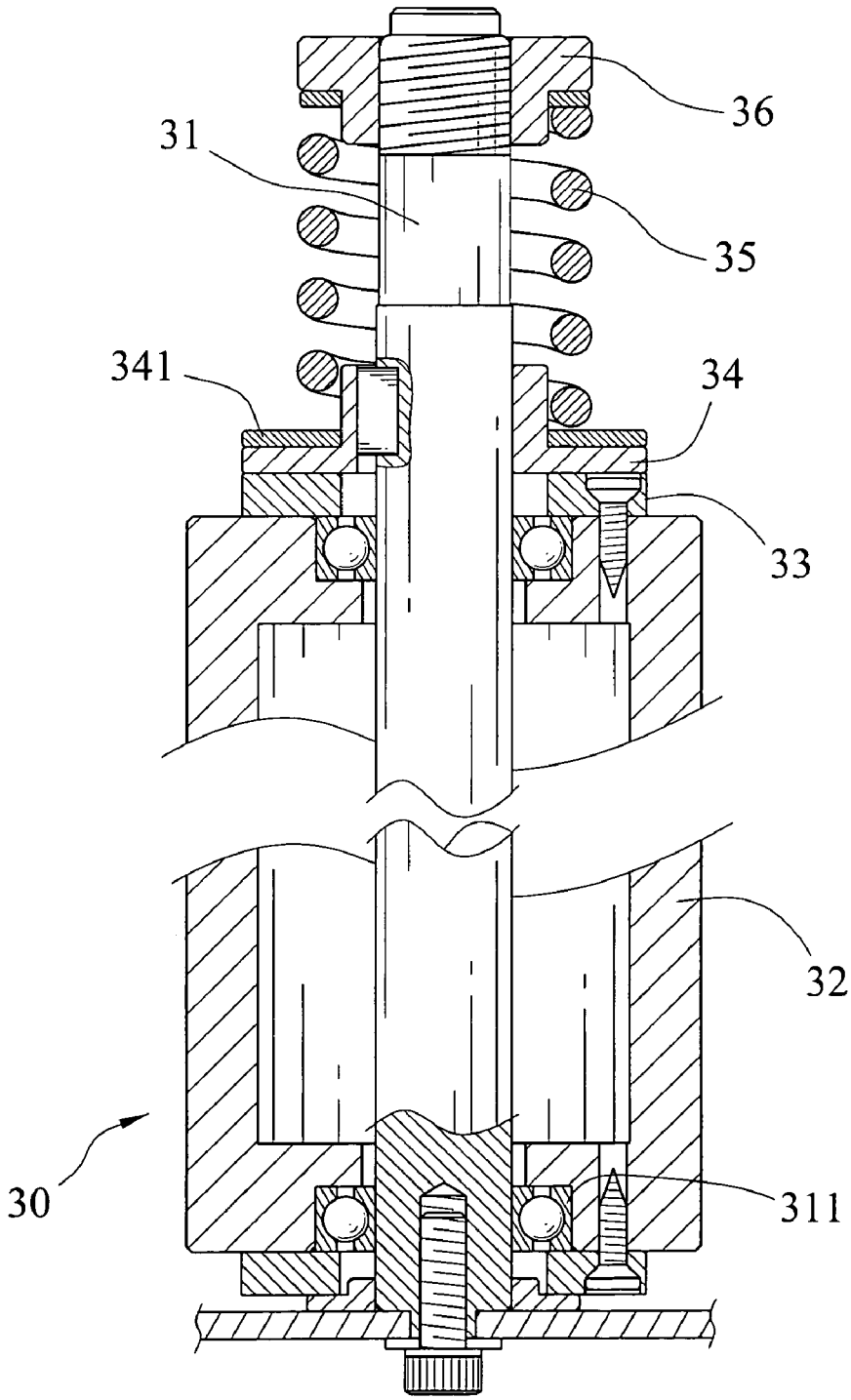
FIG. 3 is a cross sectional view of the damping unit of the present invention.

Referring to FIGS. 1 to 4, the film packing device of the present invention comprises an L-shaped base 11 including a bottom board and an upright board 111 extending from the bottom board, a top plate 12 is connected to a top of the upright board 111 and parallel to the bottom board. A first hole 121 and a second hole 122 are respectively defined in the top plate 12. Two positioning members 10 are located on the top plate 12 and the bottom board respectively so that a roll 70 of film is connected between the two positioning members 10. A film 71 can be pulled from the roll 70 of film.

A damping unit comprises a first roller 20, a damping roller 30 and a second roller 40, the first roller 20. The damping roller 30 and the second roller 40 are connected to the base 11 respectively. The frame 21 includes a rotatable first tube 26 and a second tube 27. A shaft 271 of the second tube 27 is engaged with the first hole 121 and the second roller 40 is engaged with the second hole 122. The damping roller 30 has an end connected to the base 11 and is located between the first and second rollers 20, 40.

The frame 21 of the first roller 20 includes a bottom link 22 and a top link 23, a connection link 24 is connected between the top and bottom links 23, 22. The first tube 26 is rotatably connected between the top and bottom links 23, 22. A shaft 271 of the second tube 27 extends through the top link 23 and is fixed to the top plate 12 of the base 11. The second tube 26 is pivotable relative to the shaft 271.

The damping roller 30 includes an axle 31 with a rotatable member 32 rotatably mounted thereto. Two bearings 311 are mounted to the axle 31 to allow the rotatable member 32 to be rotatable about the axle 31. A brake disk 33 is fixed to an end of the rotatable member 32 and a contact disk 34 is fixedly mounted to the axle 31 and in contact with the brake disk 33. A washer 341 is overlapped on the contact disk 34 and the axle 31 extends through the washer 341. A spring 35 is mounted to the axle 31 and has a first end biased on the washer 341 and an adjustment nut 36 is threadedly connected to the axle 31 and biases a second end of the spring 35. The spring 35 applies a force to the contact disk 34 toward the brake disk 33.

The film 71 goes partially around the first tube 26, the second tube 27, at least half of an outer periphery of the damping roller 30 and then partially around the second roller 40.

It is noted that the first and second rollers 20, 40 are located at a range of a quarter of the outer periphery of the rotatable member 32 so that the film 71 goes around three quarters of the outer periphery of the rotatable member 32.

By rotating the adjustment nut 36 to adjust the force that the spring 35 applies to the washer 341 and the contact disk 34, the brake disk 33 on the rotatable member 32 is pressed by desired force so that the speed of rotation of the rotatable member 32 is controlled. The film 71 goes 3 quarters of the outer periphery of the rotatable member 32 so that the tension of the film 71 can be adjusted.

When the object to be wrapped is rotated, the tension of the film 71 is controlled by adjustment of the adjustment nut 36, the film 71 is properly wrapped onto the object regardless of distance from the roll 70 of film.

Figure 4:
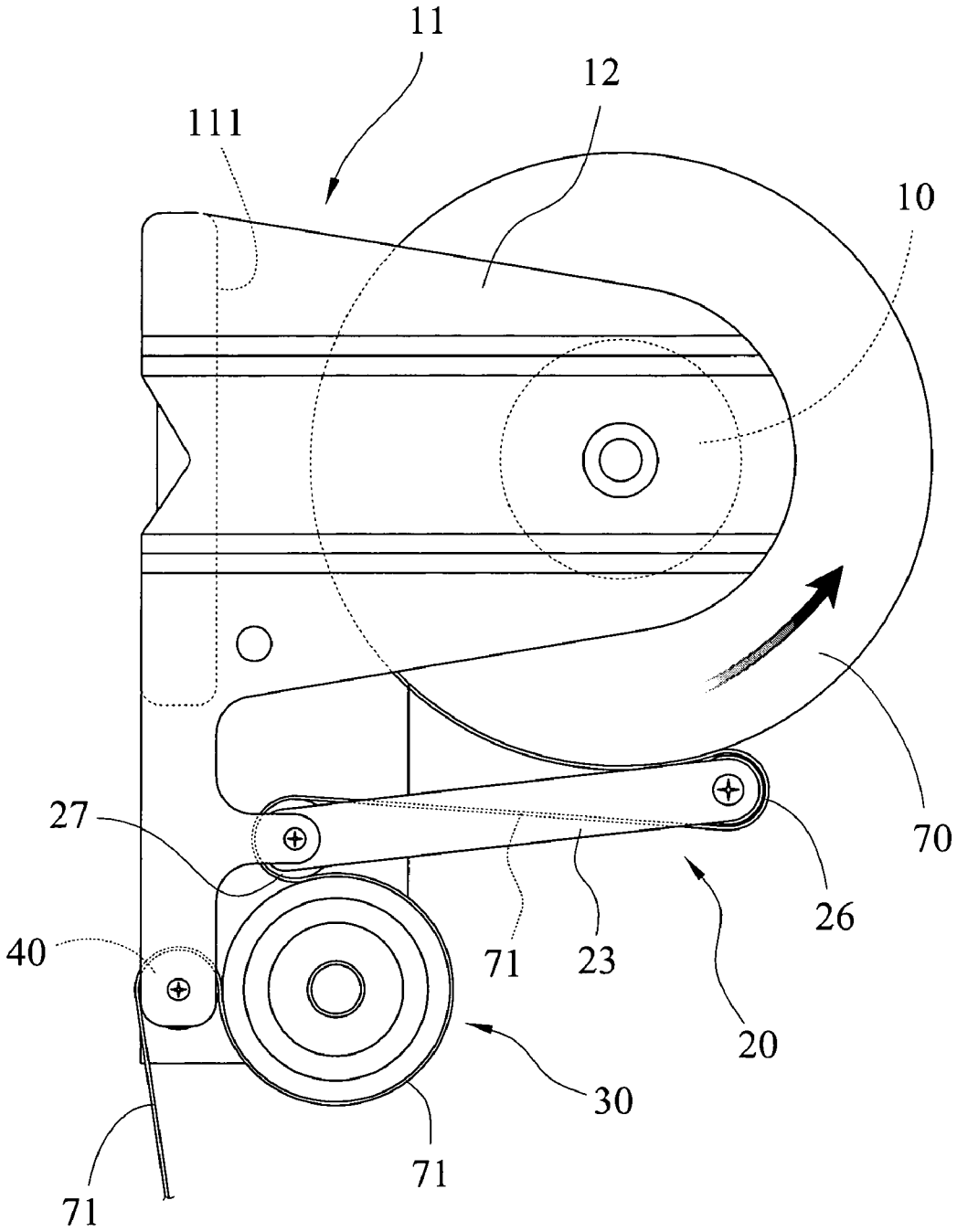
FIG. 4 is a top view to show that the film goes through the damping unit of the present invention.
Figure 5:
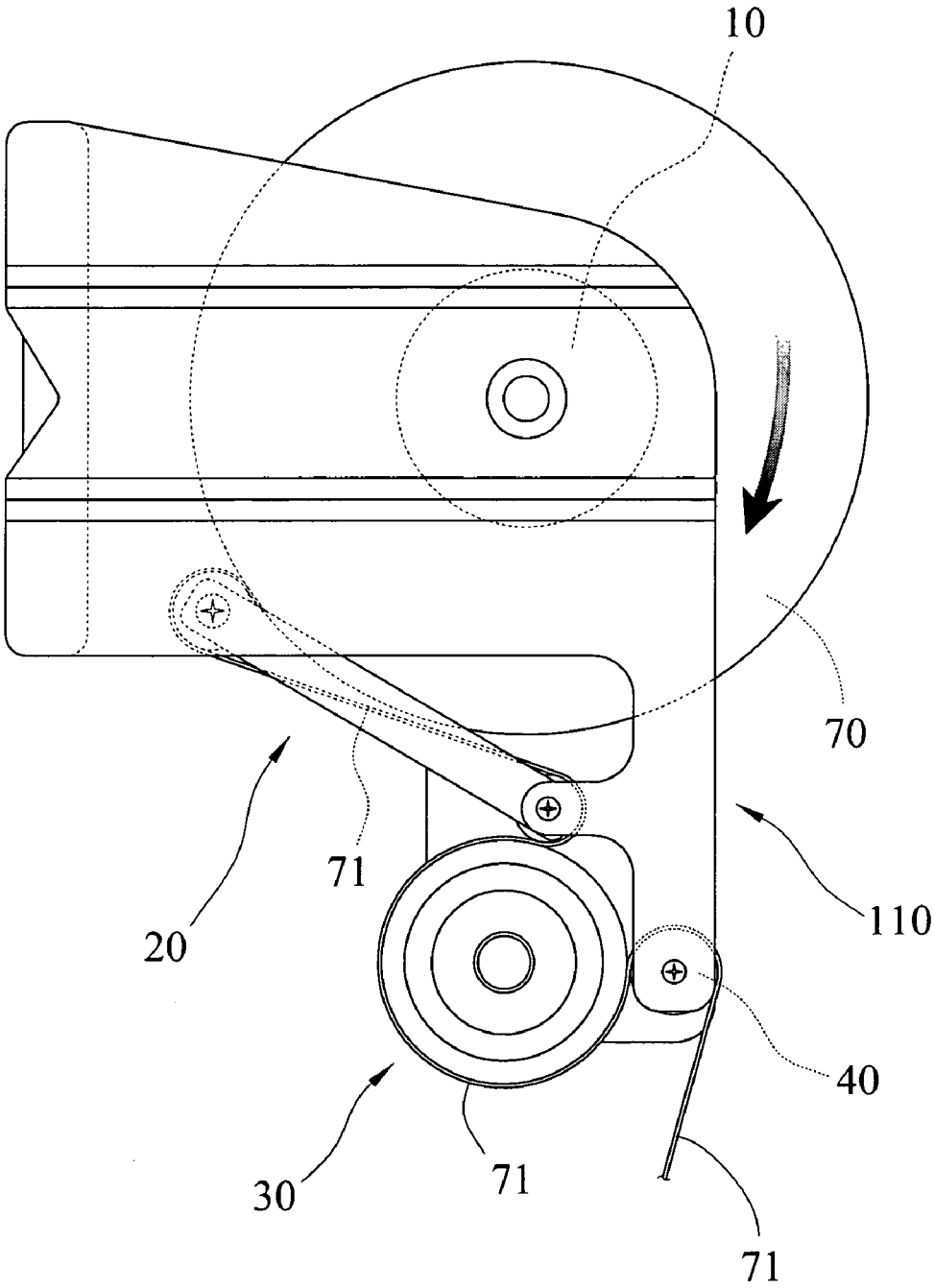
FIG. 5 is a top view to show another embodiment of the base of the damping unit of the present invention.
Figure 6:
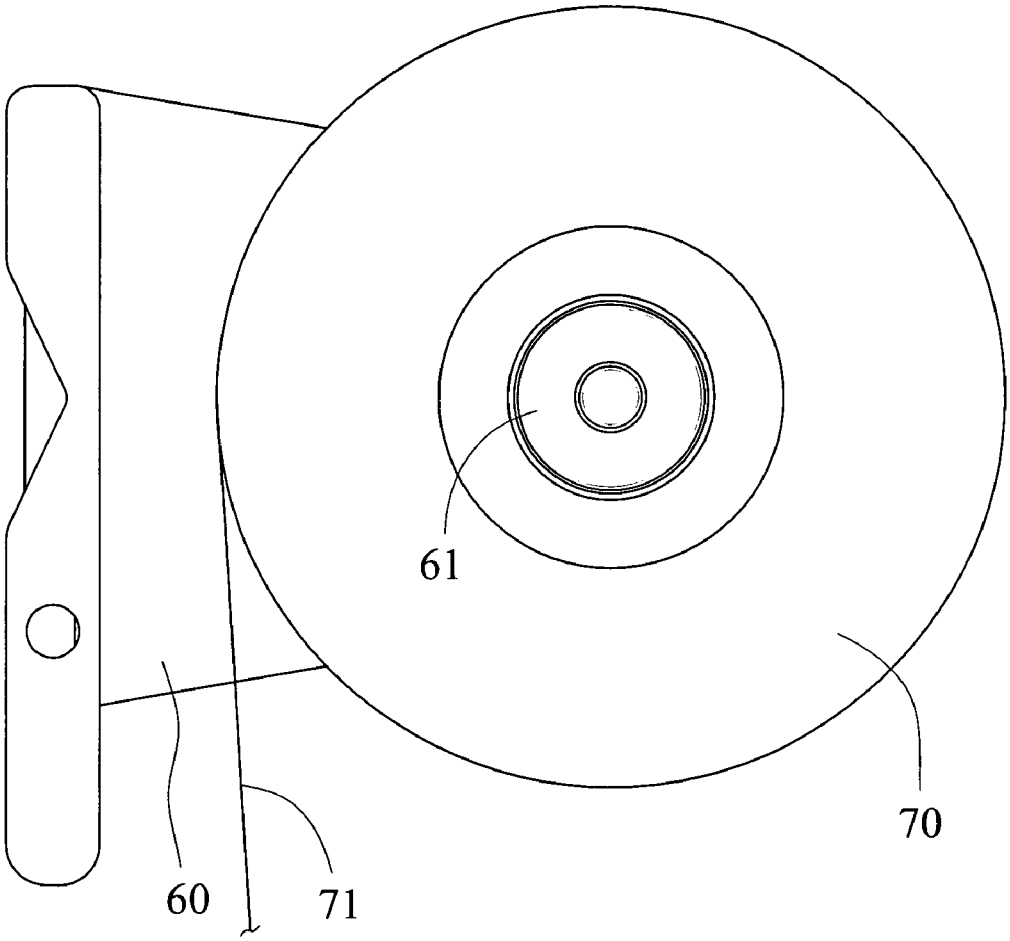
Fig 6 ( Prior Art )
FIG. 6 is a top view to show a conventional film packing device.

FIG. 5 shows another embodiment of the base of the damping unit of the present invention, wherein a second embodiment of the base 110 replaces the base 11 in FIG. 4 and the relative relationship between the first and second rollers 20, 40 and the damping roller 30 is the same as that in FIG. 4. The tension of the film 71 can also be controlled.

While we have shown and described the embodiment in accordance with the present invention, it should be clear to those skilled in the art that further embodiments may be made without departing from the scope of the present invention.

What is claimed is:

1. A film packing device comprising:

a base being an L-shaped base and having two positioning members connected thereto, the base including a bottom board and an upright board extending from the bottom board, a top plate connected to a top of the upright board and parallel to the bottom board, a first hole and a second hole respectively defined in the top plate, a roll of film connected between the two positioning members, a film being pulled from the roll of film;

a damping unit comprising a first roller, a damping roller and a second roller, the first roller, the damping roller and the second roller connected to the base respectively, a frame including a rotatable first tube and a second tube, the damping roller having an end connected to the base and being located between the first and second rollers, a shaft of the second tube engaged with the first hole and the second roller engaged with the second hole, and the film going partially around the first tube, the second tube, at least half of an outer periphery of the damping roller and then partially around the second roller.

2. The device as claimed in claim 1, wherein the frame of the first roller includes a bottom link and a top link, a connection link is connected between the top and bottom links, the first tube is rotatably connected between the top and bottom links, a shaft of the second tube extends through the top link and is fixed to the base, the second tube is pivotable relative to the shaft.

3. The device as claimed in claim 1, wherein the damping roller includes an axle with a rotatable member rotatably mounted thereto, a brake disk is located on an end of the rotatable member and a contact disk is mounted to the axle and in contact with the brake disk, a spring is mounted to the axle and applies a force to the contact disk toward the brake disk.

4. The device as claimed in claim 3, wherein the contact disk is fixedly mounted to the axle and a washer is overlapped on the contact disk and the axle extends through the washer, the spring has a first end biased on the washer and an adjustment nut is threadedly connected to the axle and biases a second end of the spring.

5. The device as claimed in claim 1, wherein the first and second rollers are located at a range of a quarter of an outer periphery of the rotatable member so that the film goes around three quarters of the outer periphery of the rotatable member.

* * * * *